United States Patent [19]

Assard

[11] Patent Number: 4,570,248

[45] Date of Patent: Feb. 11, 1986

[54] INTERFEROMETRIC HYDROPHONE REFERENCE LEG LOW FREQUENCY COMPENSATION

[75] Inventor: Gerald L. Assard, Waterford, Conn.

[73] Assignee: United States of America as represented by the Secretary of the Navy, Washington, D.C.

[21] Appl. No.: 423,889

[22] Filed: Sep. 27, 1982

[51] Int. Cl.[4] ..... H04R 23/00

[52] U.S. Cl. ..... 367/149; 367/153; 367/176; 350/96.15

[58] Field of Search ..... 367/15, 149, 140, 141, 367/173, 165, 176; 350/96.15, 96.21, 96.23, 96.29

[56] References Cited

U.S. PATENT DOCUMENTS

| | | | |
|---|---|---|---|
| 3,371,311 | 2/1968 | Cholet et al. | 367/173 X |
| 3,961,291 | 6/1976 | Whitehouse et al. | 367/141 X |
| 3,961,304 | 6/1976 | Bakewell, Jr. | 367/165 X |
| 4,158,310 | 6/1979 | Ho | 367/140 X |
| 4,160,229 | 7/1979 | McGough | 367/173 X |
| 4,283,114 | 8/1981 | Wandrack | 367/140 X |
| 4,310,905 | 1/1982 | Palmer | 367/149 X |
| 4,360,247 | 11/1982 | Beasley | 367/140 X |
| 4,375,680 | 3/1983 | Cahill et al. | 367/140 X |
| 4,418,981 | 12/1983 | Stowe | 350/96.15 |
| 4,422,167 | 12/1983 | Shajenko | 367/153 X |
| 4,433,291 | 2/1984 | Yariv et al. | 350/96.29 X |

*Primary Examiner*—Harold J. Tudor
*Assistant Examiner*—Brian Steinberger
*Attorney, Agent, or Firm*—Robert F. Beers; Arthur A. McGill; Prithvi C. Lall

[57] ABSTRACT

An interferometer inhibits a received low frequency acoustic signal that is below the pass band of interest from appearing in the output. The interferometer has a conventional optical hydrophone in the signal leg to sense both the high and low frequencies of an acoustic signal. The reference leg has means for accepting a low frequency acoustic signal to modulate the coherent light path length while inhibiting the desired high frequency signal. On recombining the signals from both the signal and reference legs the low frequency signal appearing in both legs is canceled and only the high frequency signal appearing in the signal leg reaches the output. In an alternate embodiment the reference leg mandrel is placed internal to the sensor mandrel and provides a low frequency compensation chamber.

4 Claims, 5 Drawing Figures

INTERFEROMETRIC HYDROPHONE REFERENCE LEG LOW FREQUENCY COMPENSATION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

Optical hydrophones are being developed to be deployed as acoustic sensors. An interferometric system has been devised that utilizes optical hydrophones for deployment at sea.

(2) Description of the Prior Art

In a typical interferometric system a sensor hydrophone is exposed to the acoustic pressure medium and a reference leg is isolated from the acoustic pressure medium. Both hydrophone and reference leg are constructed so that if the acoustic pressure medium were removed from the sensor hydrophone then both the sensor hydrophone and reference leg would have identical outputs. It is due to the fact that in an interferometric system the output signal of the sensor hydrophone differs from that of reference leg that enables the system to operate. the sensor hydrophone develops a signal from the acoustic pressure medium that the reference leg does not see. This enables an output to be developed once the signals from the sensor hydrophone and reference leg are recombined.

SUMMARY OF THE INVENTION

The present invention provide a fiber optic interferometric system that only detects signals above a predetermined frequency. The system generates the low frequency band of unwanted signals in both the sensor and reference legs. The detection portion of the system seeing no difference in the low frequency signals emanating from the sensor and reference legs fails to detect any low frequency signals. At high frequencies only the sensor leg generates signals and these are detected for processing. The reference leg that generates low frequency signals and inhibits high frequency signals has a fiber optic wound mandrel located inside an apertured chamber that inhibits outside acoustic pressure above a predetermined frequency.

DESCRIPTION OF THE PREFERRED EMBODIMENT

Figure 1:
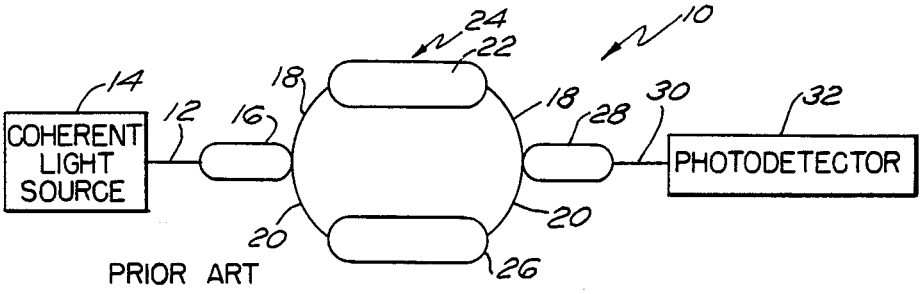
FIG. 1 is a diagram of a typical fiber optic interferometer hydrophone system.

Referring now to FIG. 1 there is shown a block diagram of a typical fiber optic interferometric hydrophone system 10 which is helpful in understanding the present invention. In FIG. 1 an optical fiber 12 provides a light path from a coherent light source 14 to a three dB coupler 16. This three dB coupler 16 divides the single coherent light into two equal energy coherent light paths. One path is through the sensor optical fiber 18 and the other through the reference optical fiber 20. The sensor optical fiber 18 must be lengthy to provide for sensitivity. Typical lengths in use range from fifty to two hundred meters. This lengthy fiber 18 is wound onto a mandrel 22 to provide for a hydrophone 24. A typical hydrophone mandrel 22 may be from four to forty centimeters in length with a length to diameter ratio ranging from one to forty.

The reference path fiber 20 must match the length of the sensor path fiber 18. Hence, the reference path fiber 20 is wound onto a second mandrel 26. The reference mandrel 26 can have different length to diameter dimensions than those pertaining to the sensor mandrel 22. The reference leg comprising fiber 20 and mandrel 26 must be completely isolated and removed from the acoustic medium of interest. The coherent light of the continuing sensor path fiber 18 is combined in the second three dB coupler 28 with the continuing leg of the reference path fiber 20. The three dB coupler 28 acts like a detector to extract the acoustic modulation that appears on the sensor fiber 18 due to the acoustic pressure fluctuations imposed onto the hydrophone sensor 24. The fiber wound mandrel hydrophone sensor 24 produces dimensional changes in the fiber which in turn alter the coherent light path length. The independent path length variations will appear as noise in the three dB coupler 28. The acoustic generated change in path lengths of the sensor fiber 18 produce a phase shift relative to the coherent light of the reference fiber 20. These phase differences are combined in the three dB coupler 28 to develop an intensity modulated light that is available for monitoring in the output fiber 30. The output fiber 30 is then terminated into a photodetector 32 to convert the light energy into electrical energy for processing.

Figure 2:
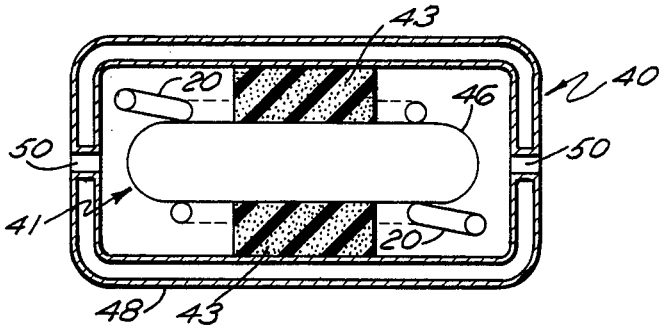
FIG. 2 shows a sectional view of a low frequency compensation system in accordance with the present invention for use in a fiber optic interferometric hydrophone system.

The optics of the interferometric hydrophone system 10 do not provide for out-of-band low frequency rejection. FIG. 2 describes a sensing system 40 that can be utilized to attenuate the out-of-band low frequency signals.

FIG. 2 shows a sectional view of a low frequency compensation system 40. The reference leg 41 includes the input reference fiber 20 that forms a reference winding, a reference mandrel 46 and the continuing reference fiber 20. The reference leg 41 is supported with open cell foam 43 and housed within the double walled chamber 48 which includes tubular orifices 50 that have the proper dimensions to provide for low frequency compensation within the chamber 48. The double walled chamber 48 and the open cell foam 43 both provide for acoustic decoupling. These orifices 50 present an acoustic low pass filtering characteristic to the environment within the chamber 48. Out-of-interest band low pass signals modulate the coherent light path length in the reference leg 41 to compensate for the modulated light path length within the sensor leg. The sensor leg can be physically separated from system 40 as long as the sensor leg receives the same acoustic signals as system 40. The recombination of the sensor signals with the reference signals from system 40 when properly phase will provide a null in the low frequency response of the sensing system. The chamber 48 provides for the isolation of the reference leg 41 from the high in-band acoustic frequencies of interest and therefore present a stable constant path length through the reference fiber 20 for the high frequencies.

Figure 3:
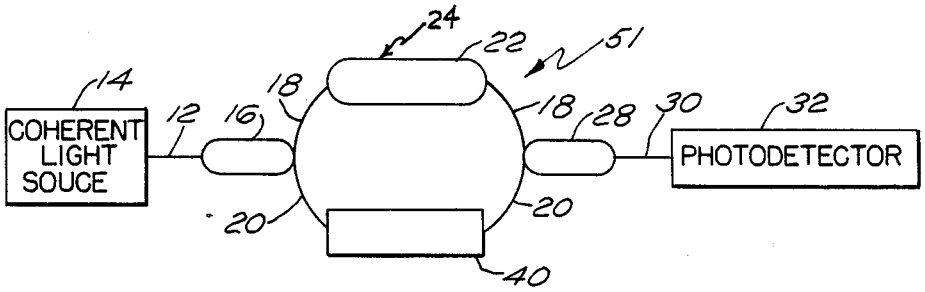
FIG. 3 shows a diagram of a fiber optic interferometric hydrophone system utilizing the low frequency compensation system of FIG. 2.

FIG. 3 shows a block diagram of an interferometric system 51 that utilizes the low frequency compensation system 40 to replace the reference mandrel 26 of FIG. 1. In operation the low frequency compensation system 40 is subjected to the same acoustic pressures as hydrophone 24 in FIG. 1. This differs from the operation of the system in FIG. 1 as the mandrel 26 is isolated from acoustic pressures.

Figure 4:
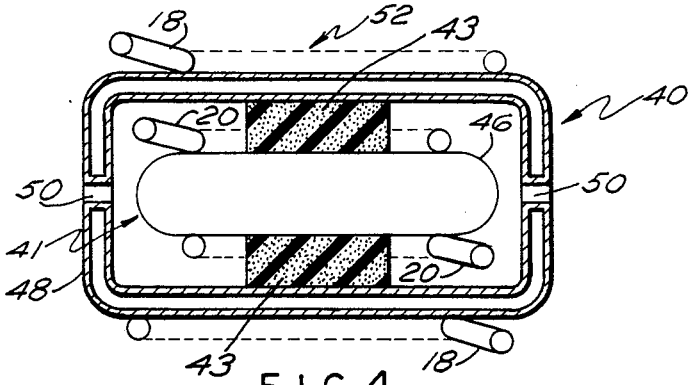
FIG. 4 shows a sectional view of a combination sensor and low frequency compensation system in accordance with the present invention for use in a fiber optic interferometric hydrophone system.

FIG. 4 combines the low frequency compensation system 40 of FIG. 2 with the sensor fiber 18 to provide a combination sensor and reference system called a sensor pair 52. The sensor fiber 18 is wrapped around the system 40 to form a sensor winding.

Figure 5:
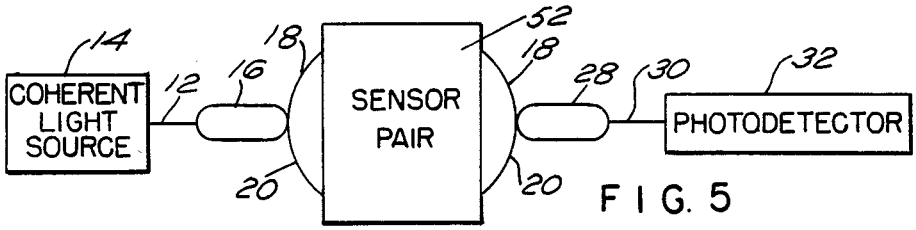
FIG. 5 shows a diagram of a fiber optic interferometric hydrophone system utilizing the combination sensor and low frequency compensation system of FIG. 4.

FIG. 5 shows an embodiment wherein the sensor pair 52 of FIG. 4 replaces both hydrophone 24 and mandrel 26 of FIG. 1.

Either design provides for subjecting the reference leg 41 to the out-of-band low pass acoustic signals while maintaining the required isolation from the in-band high pass acoustic signals of interest.

There has therefore been shown a low frequency chamber housing that will provide the advantage of subjecting the reference leg of the interferometric hydrophone to the out-of-band low frequency signals and yet provide for isolation from the higher frequency in-band signals. The low frequency energy can be many orders of magnitude higher than that of the higher frequency band of interest and, therefore, the advantages of the common mode low frequency rejection feature can be employed to assist in reducing the phase tracking dynamics of the interferometric hydrophone.

It will be understood that many additional changes in the details, materials, steps and arrangement of parts, which have been herein described and illustrated in order to explain the nature of the invention, may be made by those skilled in the art within the principle and scope of the invention as expressed in the appended claims.

I claim:

1. An interferometric hydrophone reference leg low frequency compensator and sensor comprising:

an enclosure enclosing a chamber with said enclosure having at least one aperture of a dimension to inhibit dynamic acoustic pressure above a predetermined frequency and to pass dynamic acoustic pressure below said predetermined frequency;

a first optical fiber wound around the outside of said enclosure;

a mandrel located within said chamber and affixed to the inside of said enclosure in a manner to be acoustically decoupled from said enclosure; and a second optical fiber wound around said mandrel.

2. An interferometric hydrophone reference leg low frequency compensation system comprising:

a coherent light source;

a first coupler for dividing said coherent light source into two paths, said first coupler optically connected to said coherent light source;

an interferometric hydrophone reference leg low frequency compensator connected to one of said two paths comprising an enclosure enclosing a chamber with said enclosure having at least one aperture of a dimension to inhibit dynamic acoustic pressure above a predetermined frequency and to pass dynamic acoustic pressure below said predetermined frequency, a mandrel located within said chamber and affixed to the inside of said enclosure in a manner to be acoustically decoupled from said enclosure, and a first optical fiber wound around said mandrel;

an optical sensor having a second optical fiber connected to the other of said two paths and wound around the outside of said enclosure;

a second coupler optically connected to receive signals from said interferometric reference leg low frequency compensator and said optical sensor; and a photodetector optically connected to receive signals from said second coupler.

3. An interferometric hydrophone reference leg low frequency compensator and sensor comprising:

a double-walled chamber having two spaced enclosures, one within the other, said double-walled chamber having at least one aperture passing through said two spaced enclosures, said aperture being of a dimension to inhibit dynamic acoustic pressure above a predetermined frequency and to pass dynamic acoustic pressure below said predetermined frequency;

a first optical fiber wound around the outside of the outer enclosure of said double-walled chamber;

a mandrel located within said chamber;

acoustic decoupling means affixed between said mandrel and the inner enclosure for providing acoustic decoupling in combination with said double-walled chamber between said mandrel and the outside said outer enclosure; and a second optical fiber wound around said mandrel.

4. An interferometric hydrophone reference leg low frequency compensation system comprising:

a coherent light source;

a first coupler for dividing said coherent light source into two paths, said coupler optically connected to said coherent light source;

an interferometric hydrophone reference leg low frequency compensator and sensor connected to provide for said two paths of said first coupler, said interferometric hydrophone reference leg low frequency compensator and sensor comprising a double-walled chamber having two spaced enclosures, one within the other, said double-walled chamber having at least one aperture passing through said two spaced enclosures of a dimension to inhibit dynamic acoustic pressure above a predetermined frequency and to pass dynamic acoustic pressure below said predetermined frequency, a first optical fiber wound around the outer surface of said outer enclosure of said double-walled chamber, a mandrel located within said chamber, acoustic decoupling means affixed between said mandrel and the inner surface of the inner enclosure of said chamber for providing acoustic decoupling in combination with said double-walled chamber between said mandrel and the outer surface of said outer enclosure, and a second optical fiber wound around said mandrel;

a second coupler optically connected to receive signals from said complementary interferometric hydrophone reference leg low frequency compensator and sensor; and a photodetector optically connected to receive signals from said coupler.

* * * * *